United States Patent [19]

Zijlstra

[11] 4,138,747

[45] Feb. 13, 1979

[54] DRAINAGE FITTINGS AND/OR WASH-HOUSE FITTINGS

[75] Inventor: Jan G. H. Zijlstra, Auckland, New Zealand

[73] Assignee: Ahi Operations Limited, Auckland, New Zealand

[21] Appl. No.: 740,344

[22] Filed: Nov. 9, 1976

[30] Foreign Application Priority Data

Nov. 19, 1975 [NZ] New Zealand ..... 179293

[51] Int. Cl.[2] ..... A47K 1/14; E03C 1/26

[52] U.S. Cl. ..... 4/286; 4/287; 4/295; 68/208; 68/DIG. 2

[58] Field of Search ..... 4/295, 286, 287, 288, 4/294, 137 R, 167, 166; 68/DIG. 2, 208

[56] References Cited

U.S. PATENT DOCUMENTS

| | | | |
|---|---|---|---|
| 2,701,582 | 2/1955 | Graham et al. | 68/208 X |
| 2,877,788 | 3/1959 | Clark | 68/DIG. 2 |
| 2,884,947 | 5/1959 | Garhardt | 68/DIG. 2 |
| 2,894,384 | 7/1959 | Smith | 68/DIG. 2 |
| 3,884,265 | 5/1975 | Fry et al. | 68/DIG. 2 |

FOREIGN PATENT DOCUMENTS

| | | | |
|---|---|---|---|
| 1107229 | 12/1959 | France | 68/DIG. 2 |
| 851864 | 10/1960 | United Kingdom | 68/DIG. 2 |

*Primary Examiner*—Henry K. Artis

*Attorney, Agent, or Firm*—Ladas, Parry, Von Gehr, Goldsmith & Deschamps

[57] ABSTRACT

A drainage fitting comprising a hollow member with an inlet thereto and an outlet therefrom. A valve is positioned or positionable within the hollow member such that by operating the valve liquid flow through the hollow member can be substantially prevented or allowed. There is a second inlet to the hollow member which is positioned such that liquid entering the hollow member from the second inlet can be directed either through the outlet or through the first inlet by operation of the valve.

13 Claims, 2 Drawing Figures

DRAINAGE FITTINGS AND/OR WASH-HOUSE FITTINGS

Figure 1:
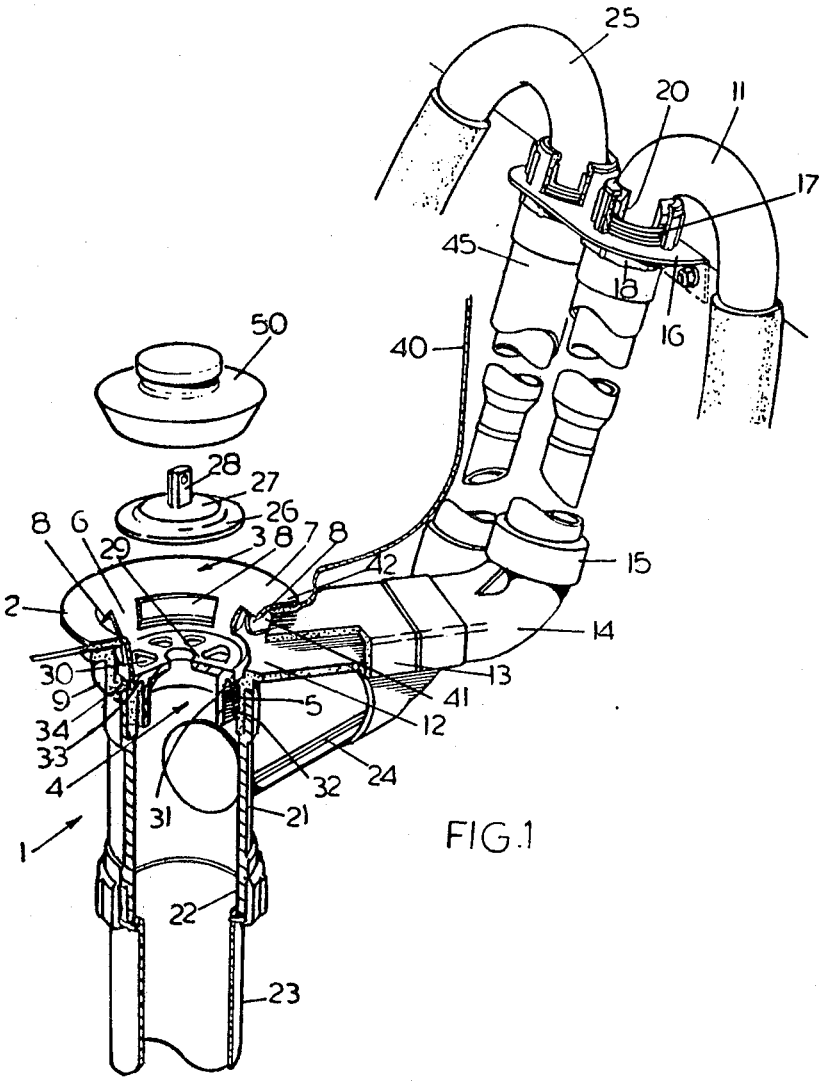

This invention relates to drainage fittings and/or wash-house fittings.

Where wash-house appliances are being used, for example, washing machines, particularly automatic washing machines, it is often desirable to discharge the washing machine into the trough or tub so that the drainage pipes of the trough or tub can be utilised for the discharge of the water from the washing machine.

The rinse water is usually discharged after each rinse but, particularly where the water supply is limited, it is often desirable for the washing or soapy water to be retained and re-used.

In these circumstances it is desirable that the trough be used as a holding tank such that the soapy water can be held while, for example, the washing is being rinsed and then once the rinse water has been discharged and the clothes removed, the soapy water can then be replaced into the washing machine.

In order that such arrangements can be used it is necessary to take the discharge, particularly of the soapy water, from the washing machine and lead it by means of pipes or hoses over the lip of the tub so that the water can be discharged into the trough.

These arrangements are not desirable, in particular, as the resulting entanglement of pipes or hoses is, to say the least unaesthetic.

A further disadvantage occurs in that the trough cannot be used, for example, for a final rinse or a holding tank for clothes or in any other manner while the soapy water is being finally discharged.

It is therefore an object of the present invention to provide a wash-house fitting or drainage fitting which will go at least some way towards meeting the foregoing desiderata and obviating or minimising the foregoing disadvantages in a simple yet effective manner or which will at least provide the public with a useful choice.

Accordingly in one aspect the invention consists in a drainage fitting comprising a hollow member having a first inlet thereto and an outlet therefrom, a valve member positioned or positionable within said hollow member to allow or substantially prevent liquid flow through said hollow member and a second inlet to said hollow member positioned such that liquid entering said hollow member from said second inlet can be directed either through said outlet or through said first inlet by operation of said valve member.

In a further aspect the invention consists in a wash-house fitting comprising a trough having a drainage outlet therefrom and a drainage fitting according to the preceding paragraph associated with said drainage outlet such that liquid from a source not forming part of the wash-house fitting may be directed into said trough through said drainage fitting or directed to waste through said drainage fitting without the need for pipes or the like to pass over the lip of said trough.

To those skilled in the art to which this invention relates, many changes in construction and widely differing embodiments and applications of the invention will suggest themselves without departing from the scope of the invention as defined in the appended claims. The disclosures and the description herein are purely illustrative and are not intended to be in any sense limiting.

Figure 2:
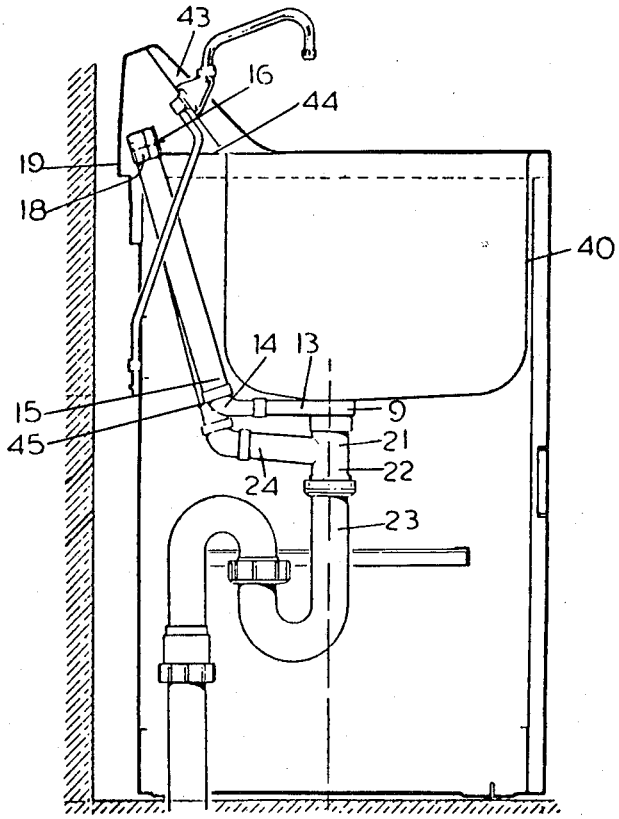

One preferred form of the invention and modifications thereof will now be described with reference to the accompanying drawings in which:

FIG. 1 is a diagrammatic part cross-sectioned view of a drainage fitting according to the invention, and FIG. 2 is a cross-sectioned view of a wash house fitting according to the invention.

In the preferred form of the invention a wash-house fitting and/or drainage fitting are provided as follows.

The drainage fitting 1 comprises a hollow member 2 which has an inlet 3 thereto and outlet 4 therefrom. The inlet 3 is at the end which is disposed in use at the upper end of the fitting and the outlet is at the lower end in use.

The lower end of the hollow member 2 has an inwardly directed flange 5.

The upper end of the hollow member 2 may be splayed outwardly upwardly as at 6 and an out-turned rim or flange 7 may be provided at the upper end.

A second inlet to the fitting is provided and the second inlet is preferably formed by one or more such as four or five apertures 8 provided through the wall of the hollow member at or adjacent the upper end of the hollow member 2 in use.

So that liquid can be led to the apertures 8 a housing 9 is provided which is positioned in the manner of a hollow annular member around the apertures 8 so that a water passageway 10 is provided between the housing 9 and hollow member 2. A pipe hose or the like 11 is engaged with an aperture 12 in the housing 10. The pipe hose or the like 11 may be engaged with the housing 9 in any desired manner such as by a socketed extension 13 extending from the housing 9. An adaptor 14 is then engaged into the socketed extension 13. The pipe hose or the like is then inserted into a connector 15 connected between the adapter 14 and a mounting bracket 16. Thus the connector 15 may be threaded at end 17 and nut 18 fitted thereon. A flanged nut 19 is then engaged with the threaded end 17 after a sealing ring 20 has been inserted between the threaded end 17 and the pipe 11. The flanged nut 19 tightens onto the sealing ring 20 to substantially prevent air leaks through this joint. The sealing ring is preferably shaped to have a cross section in the form of a truncated isosceles triangle.

The lower end of the hollow member 2 is extended downwardly and to this end a Y or T-shaped extension member 21 may be provided, the lower end 22 of which leads, for example, to a waste trap 23 and an inlet 24 of which is available to be connected by a further hose pipe 25 or the like as will be described later. The lower end 22 is preferably of a configuration such that standard drainage traps can be fixed thereto.

A diversion plug or valve is provided such that the liquid entering through the apertures 8 can be directed to either the inlet 3 or the outlet 4 of the hollow member 2 and the diversion plug may comprise a plug 26 in the form of a disc 27 formed, for example, of a plastics material having a handle grip 28 thereon which is positionable in the throat of the hollow member 2. So that the plug 26 may close the hollow member, a grille or plate 29 is provided below apertures 8, which grille or plate 29 has an upper end through which apertures 30 are formed and a lower end on which a cylindrical thread is formed as at 31, the thread being on the outer surface so as to engage a thread 32 formed on the housing 9. The grille 29 has a ledge 33 thereon and the housing 9 a rebate 34 so that the flange 5 of the hollow member 2 may be clamped between the ledge 33 and rebate 34.

Thus, the plate or grille 29 is screwed into the hollow member 2 and housing 9 and the disc 26 is of a diameter such that the holes 30 are covered by the disc 26 when the disc 26 is positioned on the grille 29.

The drainage fitting may be positioned in, for example, a trough 40 such that an aperture or hole 41 is provided through the bottom surface of the trough 40 such that a downwardly displaced portion 42 is provided. The hollow member 2 is then placed through the aperture 41 and into downwardly displaced part 42 and is held in place by the engagement of the plate or grille 29 with the housing 9. Suitable sealing washers are used as necessary.

The hollow member extension 14 is then engaged with the housing 9, by glueing, for example.

Suitable sealing compounds may be positioned between parts of the member to reduce leaks as desired and necessary.

Furthermore, the construction may be such that a housing 43 is provided, for example, along the rear edge in use of the trough 40 which housing 43 may be styled to match the similarly located parts of the particular washing machine or other appliance being used.

The plate or bracket 16 is provided at the bottom of the housing 43 and may be filled over an aperture (not shown) in plate 44 at the bottom of the housing 43. The pipes or hoses leading from the washing machine, i.e. the pipes 11 and 25, are passed upwardly through apertures (not shown) in the plate 44 such that they enter the housing 43 and the pipes 11 and 25 are connected to their respective connecting member 15 and 45.

Thus, the frequent requirement that the hose 11 in particular reach above the level of the washing machine, is met in a manner such that the pipes may still be concealed in a manner which provides a pleasing aesthetic appearance.

The use of the invention in one preferred form is as follows:

The drainage fitting may be incorporated in the bottom of a wash-house fitting such as a trough 40 and the pipe 11 may be connected, for example, to the soapy water outlet from, for example, an automatic washing machine.

The rinse water outlet from the washing machine may be connected to the arm 24 of the hollow member extension member 21.

Thus, when the washing machine is in use, the plug 26 is positioned on the plate 29 and when the wash cycle has been completed, the soapy water may be expelled from the washing machine so as to pass along the pipe 11 into the housing 9 through apertures 8 and because the plug 26 has been positioned on plate 29, the soapy water will then pass upwardly through the inlet end 3 of the hollow member 2 into the trough 40.

The rinse cycle may then be carried out in the washing machine and the rinse water expelled through the rinse water outlet to the branch arm 24 and ultimately to the waste trap. The soapy water may then be pumped back into the washing machine for re-use as desired.

This cycle may then be continued until it is no longer desired to retain the soapy water whereupon the plug 26 is removed and, if desired, a further plug 50 is inserted in the fixing member 33.

The soapy water will then pass in substantially the same manner to the apertures 8 but will then pass through the apertures 30 in the plate 29 and downwardly through the outlet end 4 of the hollow member 2 to waste.

Thus, it can be seen that a wash-house fitting and/or drainage fitting is provided which will allow soapy water, for example, from a washing machine to be retained in a simple yet effective manner and, in particular, it is not necessary for the pipes which lead the soapy water to the trough to pass over the tip of the trough which is advantageous. It is also an advantage of the invention that when the soapy water is finally expelled, the plug 50 may be inserted into the drainage fitting and the trough then used in substantially the normal manner while the soapy water is being expelled as the soapy water then has no need to pass through the trough.

Also, the construction is advantageous in use as the flow directing valve functions as part of the trough rather than as part of the drainage fitting.

The construction is also such that an aesthetic appearance is possible while yet remaining a functionally practical arrangement.

I claim:

1. A drainage fitting comprising a hollow member having a first inlet thereto and an outlet therefrom, and having a wall defining a passageway extending from said first inlet to said outlet, said hollow member being formed in said wall with at least one aperture positioned between said first inlet and said outlet and forming a second inlet to said hollow member, and the fitting further comprising a closure member which can be positioned within said hollow member to substantially close the passageway between said first inlet and said outlet while leaving said first inlet in communication with said second inlet, and means within said hollow member whereby said closure member can be positioned within said hollow member at a location between said second inlet and said outlet.

2. A drainage fitting as claimed in claim 1, further including a housing positioned about said hollow member in the region of said aperture and communicating with said aperture, said housing having therein an opening which is engaged by a conduit.

3. A drainage fitting as claimed in claim 1, wherein said hollow member is also formed in said wall with a further aperture positioned between said outlet and the location at which said closure member can be positioned within said hollow member by said means within said hollow member, said further aperture being engaged by a conduit.

4. A drainage fitting as claimed in claim 1, wherein said hollow member is disposed in use with said first inlet above said outlet, and said closure member comprises a diversion gate positionable in said hollow member at a position in use located below said at least one aperture.

5. A drainage fitting as claimed in claim 1, wherein said hollow member is disposed in use with said first inlet above said outlet, and said hollow member is shaped at the top end thereof in use such that a plug may be engaged with said top end.

6. A drainage fitting comprising a hollow member having two opposite open ends and having a wall defining a passageway extending from one end to the other end of the hollow member, said hollow member being formed in said wall with first and second apertures positioned between said one end and said other end with said first aperture nearer to said other end than is said second aperture, and the fitting further comprising a grille member disposed in the passageway between said first and second apertures, an annular housing positioned about said hollow member and engaged with said hollow member so as to enclose said first aperture and having a wall formed with a third aperture, a first conduit extending outwardly from said third aperture, a second conduit extending outwardly from said second aperture, and a closure member which can be inserted into the passageway through said other end to engage said grille member, said closure member being dimensioned so as to substantially close said passageway adjacent said grille member when it is so inserted while leaving said first aperture in communication with said other end.

7. A drainage fitting as claimed in claim 6, wherein said hollow member comprises three parts, the first being formed with said first aperture, the second part including said grille member and the third part being formed with said second aperture.

8. A drainage fitting as claimed in claim 7 wherein said first part has first and second ends and has an outward flange at said first end and an inward flange at said second end thereof, said second part has first and second ends and has an outward flange at said first end positionable on the inward flange of said first part so that said second part extends through said inward flange, the second end of said second part being engaged by said housing and said third part engaging said housing.

9. A wash-house fitting comprising a trough having a drainage outlet therefrom and a drainage fitting according to claim 1 associated with said drainage outlet such that liquid from a source independent of the wash-house fitting may be either directed into said trough through said drainage fitting by positioning said closure member within said hollow member or allowed to pass to waste through said drainage fitting by removing said closure member from said hollow member without the need for pipes or the like to pass over the lip of said trough.

10. A wash-house fitting as claimed in claim 9 wherein said fitting includes a housing adjacent the rear edge thereof which housing is constructed to substantially match similarly positioned parts of a washing machine and/or clothes dryer.

11. A wash-house fitting as claimed in claim 10 wherein a conduit conveying said liquid to said drainage fitting pases through said housing.

12. A wash-house fitting as claimed in claim 11 wherein said housing has plate at or adjacent the bottom thereof, said plate having at least two apertures therein and said conduit passing through two said apertures.

13. A wash-house fitting as claimed in claim 9 and having a shape and configuration such that space is provided therebehind to accommodate conduits.

* * * * *